US006441790B1

(12) United States Patent
Forrester et al.

(10) Patent No.: US 6,441,790 B1
(45) Date of Patent: Aug. 27, 2002

(54) SYSTEM AND METHOD FOR PROVIDING A QUASI-ISOTROPIC ANTENNA

(75) Inventors: Timothy David Forrester; Robert Bruce Ganton, both of San Diego, CA (US)

(73) Assignee: Kyocera Wireless Corp., San Diego, CA (US)

( * ) Notice: Subject to any disclaimer, the term of this patent is extended or adjusted under 35 U.S.C. 154(b) by 0 days.

(21) Appl. No.: 09/881,611

(22) Filed: Jun. 14, 2001

(51) Int. Cl.[7] ..... H01Q 1/38
(52) U.S. Cl. ..... 343/702; 343/700 MS
(58) Field of Search ..... 343/702, 700 MS, 343/720, 905; 455/89, 90, 269, 300, 351, 129

(56) References Cited

U.S. PATENT DOCUMENTS 4,736,454 A * 4/1988 Hirsch ..... 455/129
5,327,230 A * 7/1994 Dockery ..... 348/8
5,678,216 A * 10/1997 Matai ..... 455/269
6,204,819 B1 * 3/2001 Hayes et al. ..... 343/702

* cited by examiner

*Primary Examiner*—Don Wong
*Assistant Examiner*—James Clinger

(57) ABSTRACT

A system and method for wireless communications includes a wireless communications device. The wireless communications device includes a microstrip that has been structured to provide power to electrical circuitry and electrical components of the wireless communications device and has been adapted to transmit and to receive wirelessly a short-range wireless communications signal.

23 Claims, 3 Drawing Sheets

SYSTEM AND METHOD FOR PROVIDING A QUASI-ISOTROPIC ANTENNA

FIELD OF THE INVENTION

The present invention generally relates to a system and a method for providing an antenna and, more specifically, to a system and a method for providing a quasi-isotropic antenna.

BACKGROUND OF THE INVENTION

In an increasingly mobile working environment, short-range communications standards were developed to help in eliminating wires and cables between stationary devices, mobile devices and/or combinations thereof. Examples of short-range communications standards include, for example, IEEE 802.11 and HyperLan. Another example of a short-range communications standard is the global standard called Bluetooth. Bluetooth is a relatively short-ranged wireless technology that has found application in ranges under approximately 100 yards and has proven popular in providing personal area networks (PANs) located in homes and small offices. Unlike other conventional wireless techniques such as infrared (e.g., IrDA), Bluetooth does not require a direct line of sight for communications. In addition, Bluetooth can provide, for example, point-to-point and/or point-to-multipoint connections in piconet and/or scattemet configurations.

Bluetooth generally includes hardware components, software and interoperability requirements. Bluetooth hardware includes a 2.4 GHz Bluetooth radio and provides spread spectrum techniques such as frequency hopping. For example, Bluetooth may operate in a 2.4 GHz to 2.48 GHz range in which signal hops may occur among 79 frequencies at 1 MHz intervals. Furthermore, at present, Bluetooth can support voice channels, for example, of 64 kb/s and asynchronous data channels of, for example, 723.2 kb/s asymmetric or 433.9 kb/s symmetric.

In theory, Bluetooth technology can be installed in handheld wireless communications devices such as, for example, cellular phones or personal digital assistants (PDAs). For example, a Bluetooth antenna can be mounted on a handheld device in addition to the cellular antenna. However, in general, Bluetooth technology tends to interfere with the cellular transceivers including cellular antennas. Furthermore, the converse is true that cellular transceivers including cellular antennas tend to interfere with Bluetooth technology. Accordingly, neither the Bluetooth antenna nor the cellular antenna works effectively.

In another conventional device, a Bluetooth patch antenna is placed on the back of the cellular phone with additional shielding between the Bluetooth antenna and the back of the cellular phone. However, such an arrangement suffers if, for example, the cellular phone is disposed on its back on a table, then the Bluetooth antenna is blocked by the shielding and the table from effective Bluetooth communications.

The consequences become exacerbated in situations in which the Bluetooth technology is used for automated communications in which the user and/or the local wireless network may rely. For example, the Bluetooth technology may be configured to transfer e-mail messages from a local wireless network in an office to the cellular/Bluetooth handheld device carried by the user when the user is in range (e.g., in the office) of the local wireless network. If the user places the handheld device in such an orientation as to effectively shield the Bluetooth antenna from the local wireless network (despite being in range of the local wireless network), then the e-mail messages will not be transferred to the handheld device, the user will be unaware of communications problems and the user will assume that he or she had no unread e-mail messages on the local wireless network.

SUMMARY OF THE INVENTION

The present invention alleviates to a great extent the disadvantages of conventional apparatus and methods for wireless communications.

In a preferred embodiment, the present invention provides a system and a method for wireless communications including a wireless communications device. The wireless communications device includes a microstrip that has been structured to transmit and to receive wirelessly a short-range wireless communications signal. The microstrip may use any conducting material present on the printed wiring board. This material may form, for example, power lines and/or any other signal lines that form a part of the wireless device's electrical circuitry.

The present invention has an advantage by using existing shielding to provide isolation between the existing antenna and the microstrip which has been adapted to be a short-range antenna.

The present invention also has an advantage in that the meandering line shape of the microstrip provides an antenna with quasi-isotropic radiation characteristics. Such quasi-isotropic radiation characteristics are further enhanced in configurations in which the micro strip is disposed on the front side and the rear side of a printed circuit board of the wireless communications device.

The present invention further has an advantage in that, for short-range communications, an additional antenna and/or additional shielding need not be added to an already crowded circuit board of the wireless communications device.

These and other features and advantages of the present invention will be appreciated from review of the following detailed description of the present invention, along with the accompanying figures in which like reference numerals refer to like parts throughout.

DETAILED DESCRIPTION OF THE INVENTION

Figure 1:
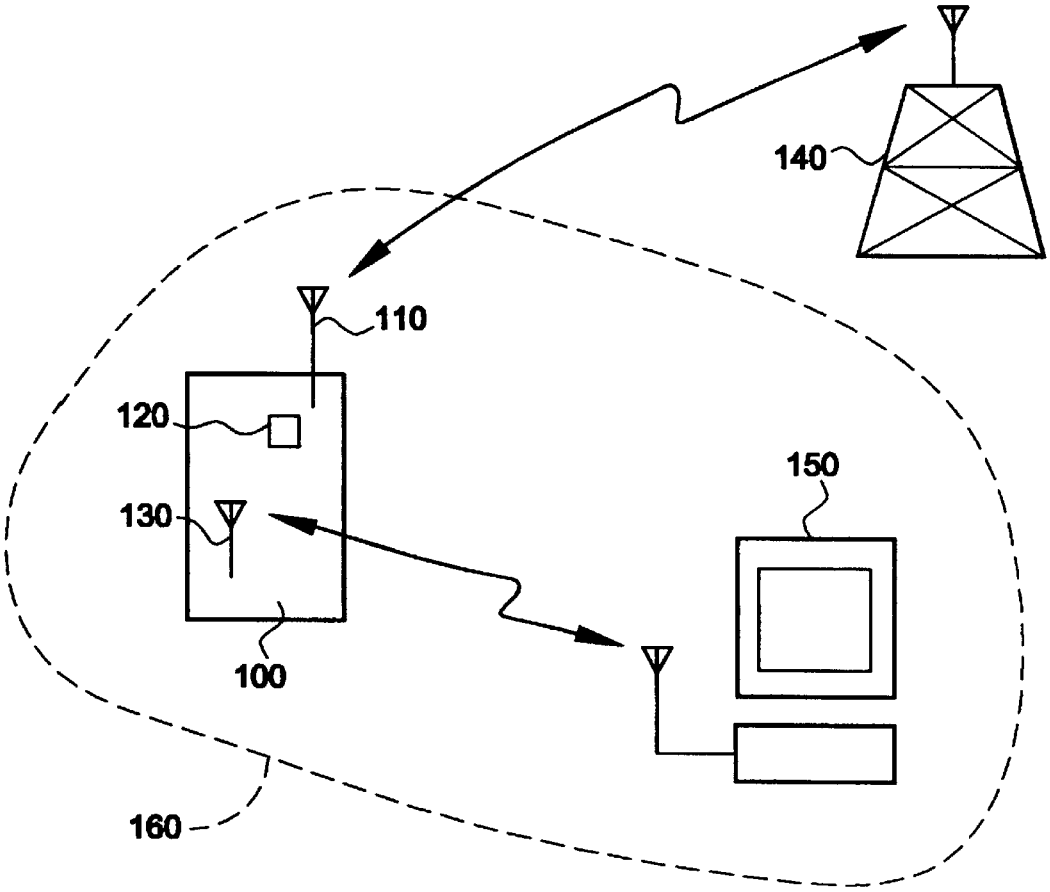
FIG. 1 is a schematic representation illustrating an exemplary embodiment of a wireless communications device according to the present invention.

FIG. 1 illustrates an exemplary embodiment of a wireless communications device 100 according to the present invention. The wireless communications device 100 may include, for example, a handheld wireless communications device, a mobile phone, a car phone, a cellular and/or a personal communications services (PCS) phone, a cordless phone, a laptop computer or other computing device with a wireless modem, a pager and/or a personal digital assistant (PDA). The wireless device 100 may be digital or analog or some combination thereof. Indeed, the present invention contemplates other forms of wireless communications devices known to one of ordinary skill in the art.

As illustrated in FIG. 1, the wireless communications device 100 includes a first antenna 110, shielding 120 and a second antenna 130. In an exemplary embodiment, the wireless communications device 100 is a cellular phone; the first antenna 110 is a code division multiple access (CDMA) antenna; the second antenna 130 includes a short-range antenna (e.g., a Bluetooth antenna or other short-range communications antennas) in accordance with the present invention. The shielding 120 provides isolation between, for example, the Bluetooth antenna 130 and the CDMA antenna 110.

The first antenna 110 is in two-way wireless communications with a base station 140. The base station 140 may be part of, for example, an array of base stations 140 or cells which are part of a wireless communications network (e.g., a CDMA cellular network). The second antenna 130 may be in two-way communications with a short-range wireless communications network 150 when the wireless communications device 100 is within a range area 160 of the short-range wireless communications network 150.

In operation, a user may access the base station 140 via the first antenna 110. Thus, for example, the user may make a wireless CDMA telephone call using the first antenna 110 of the wireless communications device 100. Furthermore, if the user enters the range area 160 of the short-range wireless communications network 150, then the second antenna 130 may be used to automatically and seamlessly establish two-way communications with the short-range communications network 150.

In an exemplary embodiment, the short-range wireless communications network 150 includes or is part of an office network which may include devices and/or networks coupled by short-range wireless communications (e.g., using Bluetooth technology) and/or devices coupled by, for example, local area networks via cables. When the user enters the range area 160 (e.g., the office building), the wireless communications device 100 and the office network 150 automatically and seamlessly establish two-way communications. Thus, for example, the user may print out a hardcopy of an e-mail, that has been loaded onto the wireless communications device 100, to a printing device that is coupled to or a part of the office network 150. In another example, the user may wirelessly access the Internet via the office network 150, which itself is connected to the Internet via, for example, a cable modem. The user may use the wireless communications device 100 to call or to interact with others devices or users that are coupled to or part of the office network 150. Conversely, devices or users that are coupled to or part of the office network 150 may call or interact with the wireless communications device 100.

Furthermore, information transfers between the wireless communications device 100 and the office network 150 can be automatic and seamless. This is particularly advantageous where, in the range area 160, the device 100 and the office network 150 automatically locate and interact with each other. For example, when the wireless communications device 100 enters the range area 160 of the office network 150, the office network 150 is notified that the wireless communications device 100 is within the range area 160 and automatically transmits unread e-mails to the wireless communications device 100 via the second antenna 130. The wireless communications device 100 and the office network 150 can automatically synchronize information stored in the device 100 and the office network 150. Thus, updates made to, for example, the calendar or other databases of the user stored in the wireless communications device 100 may be transferred to the calendar or other databases of the user stored in the office network 150. In another example, files or information updated on the office network 150 can be transferred to the wireless communications device 100 to update the files or information stored in the wireless communications device 100.

Figure 2:
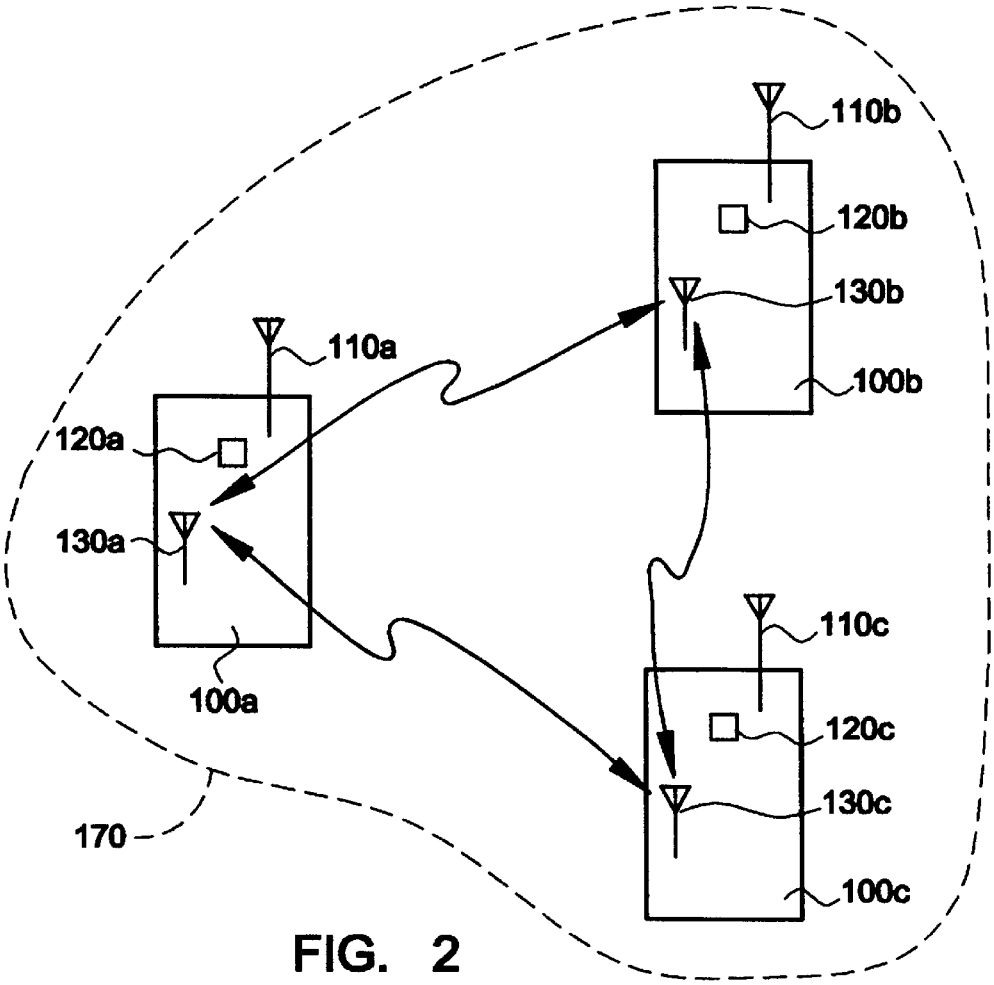
FIG. 2 is a schematic representation illustrating a plurality of wireless communications devices communicating using short-range antennas according to the present invention.

FIG. 2 illustrates three wireless communications devices 100*a–c* which are in wireless communications via second antennas 130*a–c*. Although the wireless communications devices 100*a–c* can be coupled via a short range wireless network 150 (e.g., an office network), the wireless communications devices 100*a–c* can be coupled directly or form a short-range wireless network themselves. In an exemplary embodiment, the first wireless communications device 100*a* is in direct and simultaneous two-way communications with the second wireless communications device 100*b* and the third wireless communications device 100*c*. Accordingly, the second wireless communications device 100*b* and the third wireless communications device 100*c* are in direct two-way communications with each other, or are in two-way communications via the first wireless communications device 100*a*. The present invention contemplates other numbers of wireless communications devices 100 in two-way communications directly or indirectly. Furthermore, the present invention also provides that other devices or networks can be coupled to this ad hoc network 170 by coupling (e.g., wirelessly coupling) with any of the three wireless communications devices 100*a–c*.

Figure 3A:
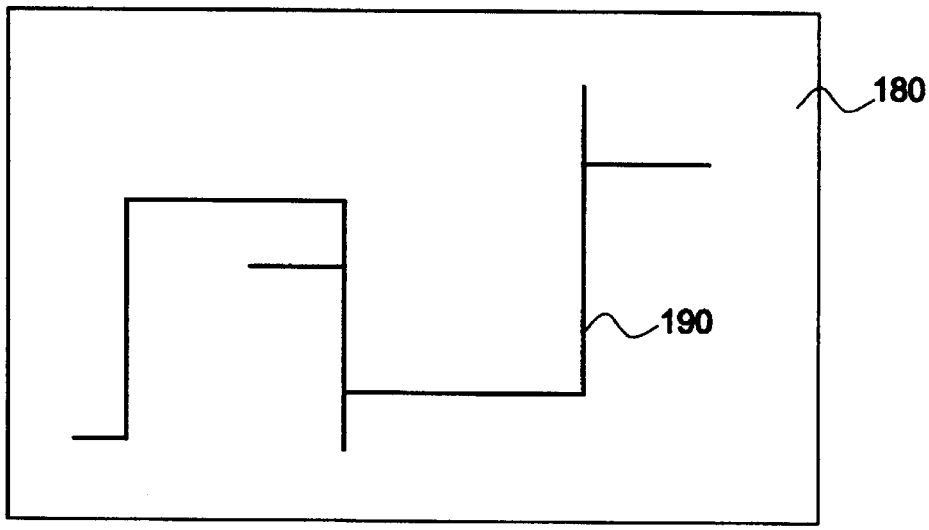
FIG. 3A is a schematic representation illustrating an exemplary embodiment of a power microstrip according to the present invention.
Figure 3B:
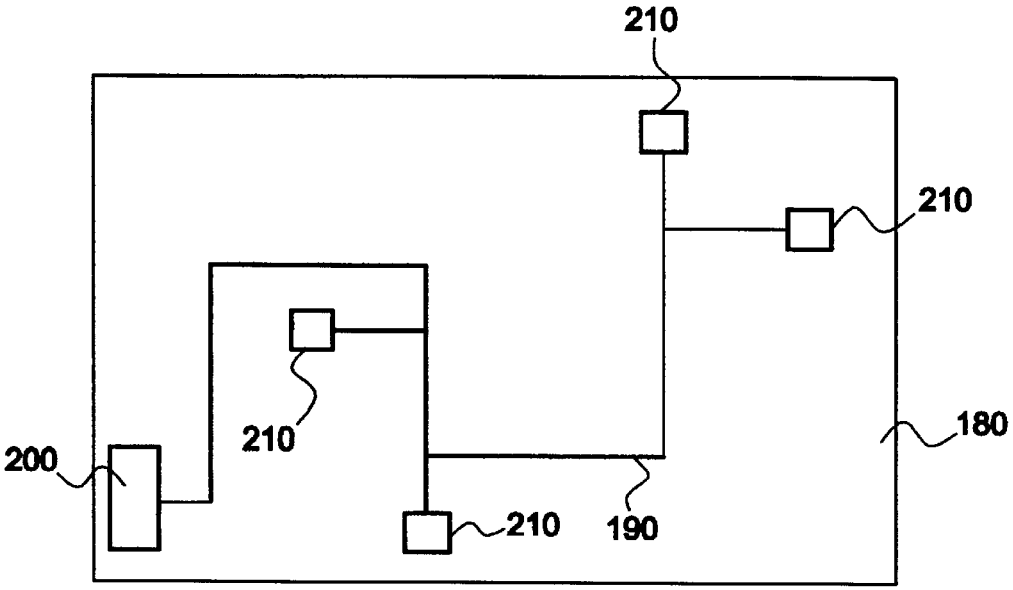
FIG. 3B is a schematic representation illustrating the power microstrip shown in FIG. 3A coupled to other circuitry according to the present invention.

FIGS. 3A and 3B are schematic representations illustrating a power microstrip 190 disposed on a printed circuit board (PCB) 180. The power microstrip 190 may be a microstrip, a line or a trace. The power microstrip 190 may be disposed on a plurality of sides and/or edges of the PCB 180. Thus, for example, the power microstrip 190 may be disposed on a front side and a back side of the PCB 180. The power microstrip 190 is illustrated as meandering in a plurality of directions with numerous branches. Furthermore, the power microstrip 190 is spread substantially throughout the PCB 180.

FIG. 3B shows the power microstrip 190 connected to electrical components and/or electrical circuitry 210 and to a power supply 200 of the wireless communications device 100. In operation, the power supply 200 supplies power to the electrical components and/or electrical circuitry 210 via the power microstrip 190.

Figure 4:
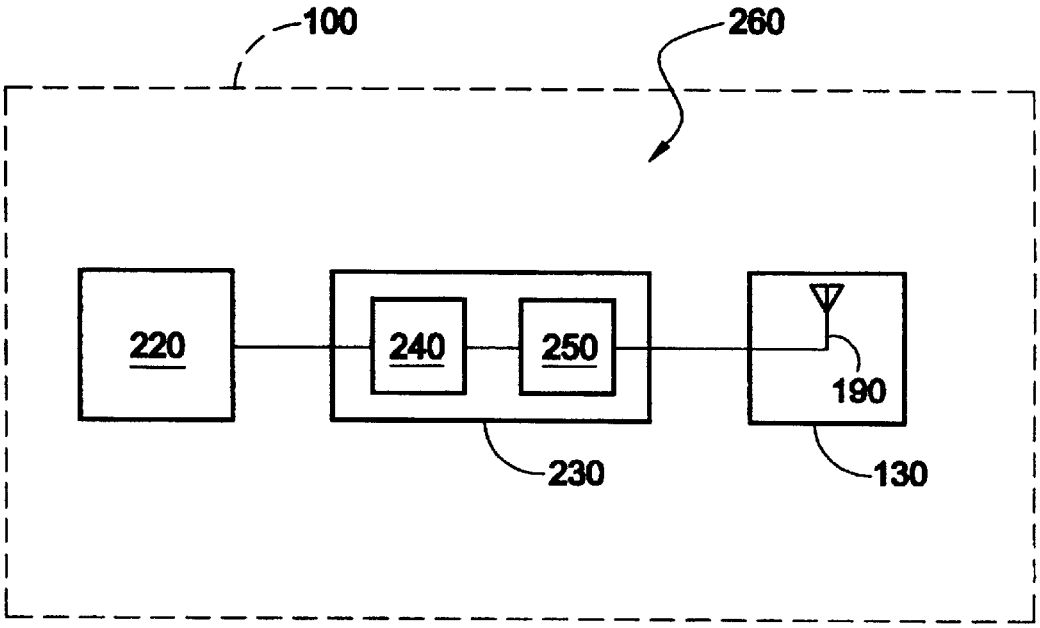
FIG. 4 is a block representation illustrating a short-range wireless communications transceiver according to the present invention.

FIG. 4 is a block representation of the wireless communications device 100 including a short-range radio transceiver 260 according to the present invention. The short-range radio transceiver 260 includes a radio-frequency integrated circuit (RFIC) 220, a compensation module 230 and the second antenna 130. The compensation module 230 also includes an optional matching impedance module 240 and a tuning module 250. The second antenna 130 includes the power microstrip 190. The present invention also contemplates that the second antenna 130 employ traces, microstrips and/or lines other than the power microstrip 190. For example, the second antenna 130 may employ a trace that meanders throughout the PCB 180, but is not the power micro strip 190.

As illustrated, the RFIC 220 is connected to the matching impedance module 240 which, in turn, is connected to the tuning module 250. The tuning module 250 is connected to the power microstrip 190. In operation, the RFIC 220 transmits to or receives from the second antenna 130 a signal that has been tuned and possibly impedance matched by the compensation module 230.

Figure 5:
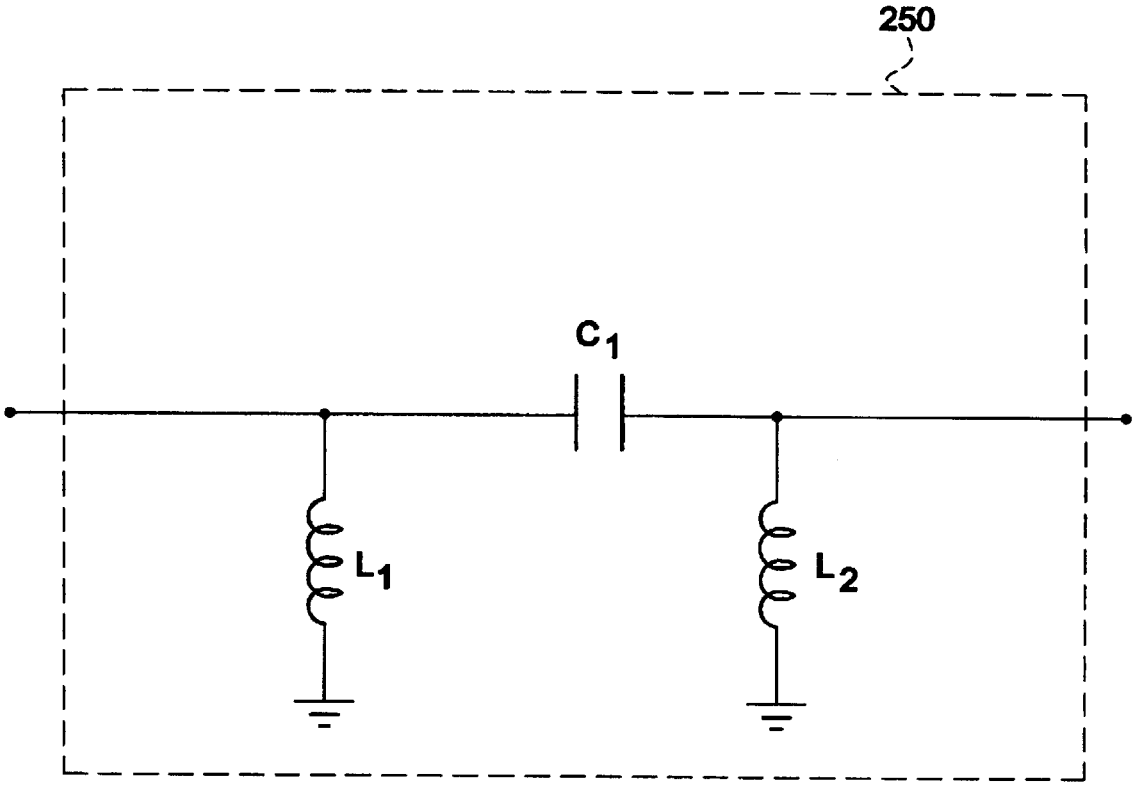
FIG. 5 is a circuit representation of an embodiment of a tuning module according to the present invention.

In an exemplary embodiment, the RFIC 220 includes conventional Bluetooth technology including corresponding hardware, software and combinations thereof. The compensation module 230 includes an optional matching impedance module 240 which matches an impedance from before the matching impedance module 240 as seen in the direction of the power microstrip 190 to an impedance from before the matching impedance module 240 as seen in the direction of the RFIC 220. The matched impedance may be a particular value having real and/or imaginary values. In an exemplary embodiment, the matched impedance value is the impedance of the RFIC 220 which is, for example, approximately 50Ω, approximately 75Ω or other impedance values. The compensation module 230 also may include a tuning module 250. The tuning module 250 may compensate for non-linear responses of the second antenna 130. FIG. 5 illustrates an embodiment of the tuning module 250 which includes inductors $L_1$, $L_2$ and capacitor $C_1$ in a particular tuning configuration according to the present invention. Clearly, the present invention contemplates other more complex tuning arrangements and their dual equivalents and may include passive elements, active elements or some combination thereof Such tuning arrangements, configurations and their dual equivalents would be available without undue experimentation to one of ordinary skill in the art.

In an exemplary embodiment, the present invention implements a lossy transmission line approach. The power microstrip 190 is adapted to provide an antenna that is electrically long and convoluted which tends to promote a quasi-isotropic radiation pattern. Although not well suited for cellular use due to its lossy nature, the power microstrip 190, by optimizing the loss, may act as a low gain antenna which finds application in, for example, Bluetooth technology.

By using the power microstrip 190 as a short-range radio frequency antenna (e.g., a Bluetooth antenna), the present invention accrues a number of advantages. For example, since the power microstrip 190 meanders throughout the PCB 180 in numerous directions and may be present on a front and a back side of the PCB 180, the power microstrip 190, when used, for example, as a Bluetooth antenna, has quasi-isotropic radiation characteristics. Therefore, because of the approximately omni-directional coverage, there is an enhanced probability that no matter what position and/or orientation the user places the wireless communications device 100, the Bluetooth antenna will be able to have or to maintain two-way communications with, for example, the office network 150 when within the range area 160.

Furthermore, since the present invention employs the power microstrip 190 in the wireless communications device 100, no additional antenna is needed. An additional advantage of the present invention is that an existing shielding 120, which normally isolates the first antenna (e.g., the CDMA antenna) 110 from the power microstrip 190, can be employed to isolate the first antenna 110 from the second antenna 130 (e.g., the Bluetooth antenna). In an exemplary embodiment, by using the existing shielding 120 and adapting the existing power microstrip 190 as described above for use in the second antenna 130, the present invention minimizes the number of additional parts which are added to the wireless communications device 100 and, in particular, to the PCB 180.

Thus, it is seen that a system and method for wireless communications are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the present invention as well.

What is claimed is:

1. A wireless communications device, comprising:

a printed circuit board including electrical components;

a power supply;

a microstrip adapted to provide power to the electrical components of the printed circuit board and be a short-range communications antenna, wherein the microstrip is disposed on the printed circuit board and coupled to the power supply; and a cellular phone antenna.

2. The wireless communications device according to claim 1, further comprising:

a shield isolating the cellular phone antenna from signal noise generated by power carried by the microstrip and from short-range communications signals transmitted or received by the microstrip.

3. The wireless communications device according to claim 1, wherein the short-range communications antenna is a Bluetooth antenna.

4. The wireless communications device according to claim 1, wherein the microstrip is a power microstrip.

5. A wireless communications device, comprising:

a printed circuit board including electrical elements;

a radio-frequency integrated circuit (RFIC) disposed on the printed circuit board;

a compensation module coupled to the RFIC and including a tuning circuit;

a trace disposed on at least one side of the printed circuit board and coupled to the compensation module, the trace providing power to the electrical elements of the printed circuit board, the trace being a short-range radio antenna, wherein the tuning circuit compensates for non-linear responses of the short-range radio antenna to radio-frequency signals; and a cellular antenna.

6. The wireless communications device according to claim 5, wherein the trace is disposed in a meandering pattern on at least one side of the printed circuit board.

7. The wireless communications device according to claim 5, wherein the short-range radio antenna is a Bluetooth antenna.

8. The wireless communications device according to claim 7, further comprising:

a shield isolating the cellular antenna from signal noise generated by power carried by the trace and from Bluetooth signals transmitted or received by the trace.

9. The wireless communications device according to claim 8, wherein the shield isolates the Bluetooth antenna from cellular signals received or transmitted by the cellular antenna.

10. The wireless communications device according to claim 5, wherein the compensation module includes an impedance matching module disposed between the tuning circuit and the trace.

11. The wireless communications device according to claim 10, wherein the impedance matching module matches an impedance as seen from before the impedance matching module in a direction toward the RFIC to an impedance as seen from before the impedance matching module in a direction toward the trace.

12. The wireless communications device according to claim 11, wherein the matched impedance is approximately 50Ω or approximately 75Ω.

13. A short-range wireless communications device, comprising:

electrical components;

a microstrip adapted to be a short-range antenna and structured to provide power to the electrical components;

a printed circuit board on which the electrical components are mounted;

a power supply connected to the microstrip and providing power to the electrical components via the microstrip; and a cellular antenna.

14. The device according to claim 13, wherein the microstrip is adapted to be a quasi-isotropic antenna.

15. The device according to claim 13, wherein the microstrip is adapted to be a Bluetooth antenna.

16. The device according to claim 13, wherein the printed circuit board has a front side and a rear side, the microstrip being disposed on both the front side and the rear side of the printed circuit board.

17. The device according to claim 13, wherein the microstrip is disposed in a convoluted pattern on at least one side of the printed circuit board.

18. The device according to claim 13, wherein the microstrip is disposed in a meandering pattern on at least one side of the printed circuit board.

19. The device according to claim 13, wherein the microstrip meanders across at least two sides of the printed circuit board.

20. A Bluetooth antenna in a handheld wireless communications device, comprising:

a meandering power microstrip that has been adapted to radiate with a short-range omni-directional radiation pattern.

21. A method for short-range wireless communications, comprising the steps of:

providing a wireless communications device comprising a printed circuit board, a microstrip disposed in a meandering pattern on the printed circuit board, a cellular antenna, and electrical components mounted onto the printed circuit board;

providing power to electrical components of a wireless communications device via the microstrip; and transmitting or receiving short-range wireless signals via the microstrip.

22. A method for adapting a microstrip to be a Bluetooth antenna in a handheld wireless communications device, comprising the steps of:

providing a printed circuit board adapted for electrical connection to a cellular antenna and to electrical components;

printing a microstrip adapted to simultaneously provide power to the electrical components and act as a short-range communications antenna, wherein the mircrostrip is printed in a meandering pattern on a printed circuit board inside the handheld wireless communications device;

impedance matching the microstrip with a Bluetooth integrated circuit; and compensating for non-linear responses of the microstrip to Bluetooth signals with a tuning circuit.

23. The method according to claim 22, wherein the step of printing includes the step of printing a microstrip on at least two sides of the printed circuit board.

* * * * *